United States Patent [19]

Schotter

[11] Patent Number: 5,042,390

[45] Date of Patent: Aug. 27, 1991

[54] APPARATUS FOR LAUCHING UMBILICAL-GUIDED MISSILES

[75] Inventor: Daniel K. Schotter, Tucson, Ariz.

[73] Assignee: Hughes Aircraft Company, Los Angeles, Calif.

[21] Appl. No.: 423,311

[22] Filed: Oct. 18, 1989

[51] Int. Cl.[5] ..... F41F 3/04; F41G 7/20; F42B 12/68

[52] U.S. Cl. ..... 102/504; 89/1.34; 89/1.811; 89/1.816; 244/3.12

[58] Field of Search ..... 244/3.12; 102/504; 89/1.34, 1.811, 1.816, 1.8

[56] References Cited

U.S. PATENT DOCUMENTS

| | | | |
|---|---|---|---|
| 3,233,548 | 2/1966 | Chilowsky | 244/3.12 |
| 3,711,046 | 1/1973 | Barhydt et al. | 244/3.12 |
| 3,868,883 | 3/1975 | Tucker | 89/1.8 |
| 4,247,059 | 1/1981 | Duke et al. | 244/3.12 |
| 4,724,768 | 2/1988 | Robinson et al. | 102/504 |
| 4,907,763 | 3/1990 | Pinson | 244/3.12 |

*Primary Examiner*—David H. Brown
*Attorney, Agent, or Firm*—R. M. Heald; C. D. Brown; W. K. Denson-Low

[57] ABSTRACT

Guided missiles (10) which trail control umbilicals such as optical fibers (20) are launched from an array (16) of launch tubes (14) that point in the same direction. A swing arm (40) extends over the face of the array (16) to capture and move the umbilicals (20) of previously launched missiles (10) away from the portion of the array (16) from which the next missile (10) will be launched, to avoid interference between the launched missile (10) and the exisiting umbilicals (20). As each missile (10) is launched, the swing arm (40) recycles to capture the umbilical (20) of the newly launched missile (10).

14 Claims, 2 Drawing Sheets

APPARATUS FOR LAUCHING UMBILICAL-GUIDED MISSILES

This invention was made with Government support under Contract No. DAAH01-89-C-0066 awarded by the Department of the Army. The Government has certain rights in this Invention.

BACKGROUND OF THE INVENTION

This invention relates to guided missiles, and, more particularly, to a launching apparatus for umbilical-guided missiles that reduces the likelihood of interference between the umbilicals of previously launched missles and those of subsequently launched missiles.

Missiles can be guided by a variety of techniques during flight. Some are self-guided by radar or infrared seekers. Others are guided from a stationary control location through an umbilical that trails from the rear of the missile during flight. Control information and signals are sent between the control location and the missile during flight. Wire guided missiles, wherein the umbilical is a metallic wire through which electrical signals are transmitted, have been known and used for some time. Optical fiber guided missiles, wherein the umbilical is an optical glass fiber through which light impulses are transmitted, are becoming of more interest at this time.

In one concept of the packaging of such umbilical-guided missiles, the missile with folded fins and control surfaces is contained within a launched tube prior to launch. The free end of the umbilical extends out the back of the missile, through the back end of the launch tube, and to the control location. The front end of the missile within the tube points toward a launch end of the tube which is sealed with a protective membrane that is perforated as the missile is launched. As the missile leaves the launch end when fired, the umbilical trails out the launch end of the tube.

It has been proposed to arrange a number of the launch tubes in an array that in turn is mounted on a carrier, giving increased firepower and also permitting economies in scale in the controller electronics. However, as an individual missile is launched from the array, the missile may become entangled with the umbilicals of previously launched missiles, resulting in damage to the umbilicals or the newly launched missile. Also, the exhaust plume of the newly launched missile may damage the umbilicals of the previously launched missiles. Since the previously launched missiles are controlled by signals sent through their umbilicals, damage to the umbilicals may result in the failure of the missile to be properly controlled, and consequently failure to accomplish its mission.

There is a need for an approach to reduce the possibility of damage to the umbilicals of previously launched missiles by a newly launched missile, or damage to the newly launched missile by the umbilicals of the previously launched missiles. The present invention fulfills this need, and further provides related advantages.

SUMMARY OF THE INVENTION

The present invention provides an apparatus for launching a plurality of umbilical-guided missiles from an array with minimal chances of damage to missiles or umbilicals resulting from contact during launch. It permits multiple missiles to be launched in a short time, from the same array. The apparatus is reliable and sturdy, and fully compatible with field operations of the missiles.

In accordance with the invention, an apparatus for launching umbilical-guided missiles comprises launching means for launching umbilical-guided missiles therefrom, the launching means including means for holding and launching at least two missiles; and means for moving the umbilical of a previously launched missile away from the path of a subsequently launched missile.

In a preferred approach the missile is guided by light signals sent through an optical fiber that extends from the tail of the missile. Television and status signals travel along the optical fiber from the missile back to the launching point and controller, and command signals travel in the opposite direction from the controller to the missile along the optical fiber.

Prior to firing, the missiles are commonly packaged in launch tubes that are placed into an array at the launching point. The launch ends of the tubes face in a common direction, so that a number of the missiles may be launched from about the same point, toward dispersed targets, in a short period of time. The means for holding of the present invention aids in managing the trailing optical fibers so that they do not become entangled with each other, do not interfere with subsequently launched missiles, and are not damaged by subsequently launched missiles.

The preferred means for holding is a swing arm mounted to the array of launch tubes or support structure, that swings over and across the launch end face of the array. It captures and retains the optical fiber umbilicals from previously fired missiles, as by forcing them to one side of the array out of the path of the next missiles to be fired. Using this approach, the missiles are typically fired in a pattern beginning at one side of the array and progressing across the array, so that the next missiles to be fired are separated from the side of the array at which firing commenced, where the umbilicals from previously fired missiles are gathered by the means for moving.

The swing arm preferably is extensible over the face of the array and retractable away from the face of the array, to permit the swing arm to recycle between launches and capture the next umbilical to be gathered. The extension/retraction function can be accomplished in any convenient manner, such as a telescoping arm or an upwardly pivoting arm.

This apparatus permits umbilical-guided missiles to be fired from an array with greatly reduced risk of entanglement among umbilicals or damage to subsequently launched missiles by the umbilicals of previously launched missiles. Other advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

In accordance with the invention, the apparatus launching a plurality of optical fiber-guided missiles comprises a plurality of elongated launch tubes fixed together in an array, the launch tubes each being oriented to launch a missile in a common direction; and means for moving the optical fibers of previously launched missiles away from the path and exhaust plume of subsequently launched missiles. More specifically, apparatus for launching a plurality of optical fiber-guided missiles comprises a plurality of elongated launch tubes fixed together in an array, the launch tubes each being oriented to launch a missile from a launch end of the tube in a common direction; a swing arm supported with the array, the arm extending over the launch ends of the tubes in the array; and a swing arm drive motor connected to the swing arm to pivot the swing arm across the launch ends of the launch tubes.

Figure 1:
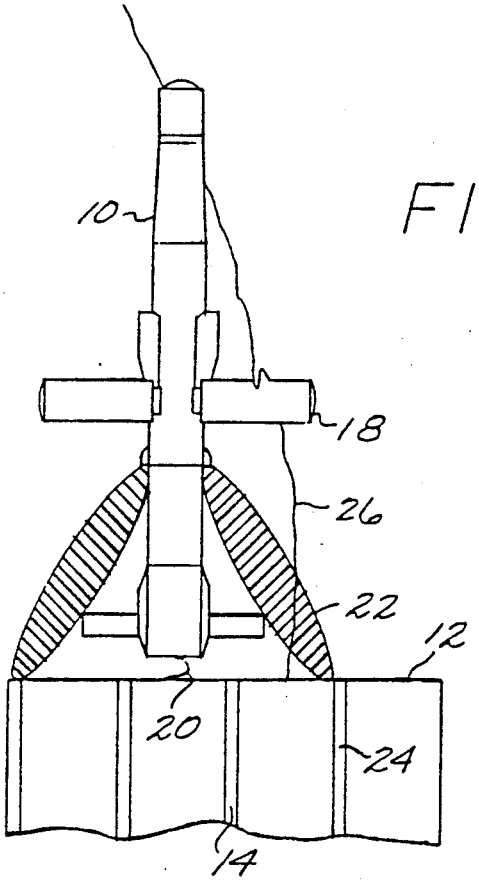
FIG. 1 is a side elevational view of a missile being launched from an array of launch tubes.

As illustrated in FIG. 1, a missile 10 may be launched from a launch end 12 of a launch tube 14, which is one of several launch tubes in an array 16. As the missile 10 is launched, wings and control surfaces, illustrated generally by numeral 18, spring to the open position shown in FIG. 1. When the missile 10 was stored in the launch tube 14, the wings and control surfaces 18 were folded for efficient storage. An umbilical in the form of an optical fiber 20 is trailed out of the back end of the missile 10. The missile 10 is propelled by rocket engines (not visible inside the missile), each of which produces an exhaust plume 22 of hot exhaust gas that extends outwardly and downwardly from the missile 10 against the face of the array 16.

The nature of the problem requiring a solution is also illustrated in FIG. 1. At a time prior to the time of FIG. 1, another missile (not shown out of the illustration) was fired from a second launch tube 24 of the array 16. A second optical fiber umbilical from the previously fired missile, numeral 26, is illustrated as extending outward from the second launch tube 24. To emphasize the nature of the possible interferences, it is assumed that the previously fired missile was directed slightly to the left in the view of FIG. 1, so that the second optical fiber 26 extends slightly to the left and over the launch tube 14.

There can be interference between the missile 10 and the second optical fiber 26 in at least two ways. First, a portion of the missile 10, such as the wing and control surface 18, may contact the second optical fiber 26. The result may be damage either to the missile 10, the second optical fiber 26, or both. Second, the exhaust plume 22 may damage the second optical fiber 26. The aiming and direction of the previously fired missile depends upon signals transmitted through the second optical fiber 26. Either mechanical damage or heat damage to the second optical fiber 26 may cause the loss of control of the previously fired missile.

Figure 2:
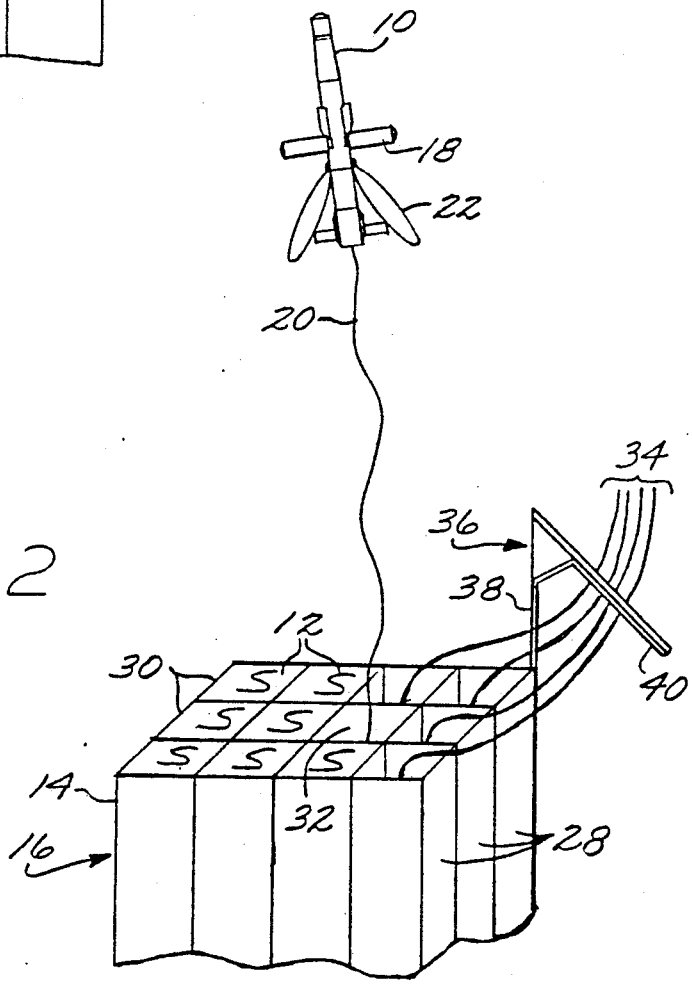
FIG. 2 is a perspective view of the array of launch tubes, with umbilicals captured by a swing arm.

FIG. 2 is a perspective view of the array 16 showing previously fired launch tubes 28, unfired launch tubes 30, and a just-fired launch tube 32. Each of the previously fired launch tubes 28 has a previously fired optical fiber umbilical 34 extending therefrom. The just fired launch tube 32 has the optical fiber 20 extending therefrom to the missile 10.

According to the preferred embodiment of the invention, a swing arm apparatus 36 is mounted to the array 16, to act as a means for moving the previously fired optical fibers 34 away from the path and exhaust plume of the missile 10, and retaining them in this position until the subsequently fired missile has cleared the array. The swing arm apparatus is illustrated more fully in FIG. 3. The swing arm apparatus 36 includes a swing arm support rod 38 extending to a distance above the launch ends of the launch tubes 14. A swing arm 40 extends outwardly over the launch ends 12 of the launch tubes 14 of the array 16. The swing arm 40 is oriented generally perpendicularly to the swing arm support rod 38.

The swing arm 40 is shown in FIG. 2 as having captured and moved away the previously fired optical fibers 34 from the path of the missile 10 and its exhaust plume 22. The swing arm 40 sweeps across the face of the array 16 over the launch ends 12 by rotation of the support rod 38, and captures all of the previously fired optical fibers 34 on one side of the swing arm 40. The rotational movement of the swing arm apparatus 36 is sufficiently far that the previously fired optical fibers 34 are moved completely away from the area where they might entangle with the missile 10 as it is fired, or be damaged by its exhaust plume 22.

Figure 3:
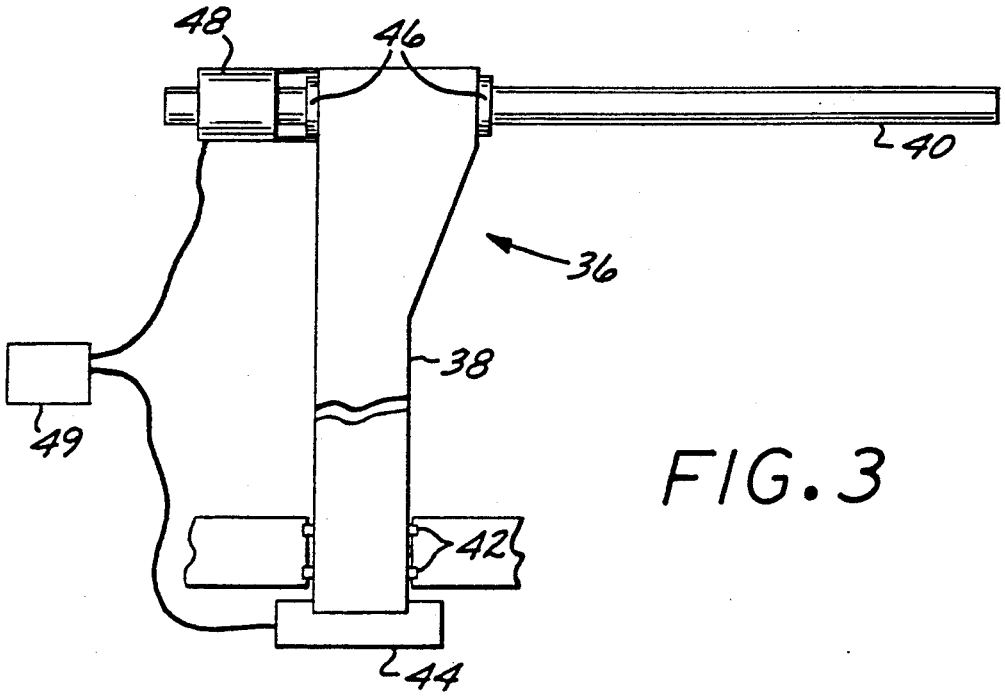
FIG. 3 is a side elevational view of one embodiment of the swing arm.

The structure of the swing arm apparatus 36 is illustrated more fully in FIG. 3. The support rod 38 is mounted with support rod bearings 42 to a rotational motor 44. Rotational motor 44 can be electric or hydraulic and rotates the support rod 38 about its cylindrical axis, producing the rotational sweeping motion of the swing arm 40 discussed previously.

The swing arm 40 is mounted to the support rod 38 on sliding bearings 46. An electric or hydraulic linear motor 48 extends and retracts the swing arm 40 with respect to the swing arm support rod 38. The swing arm 40 is desirably selectively retractable in order to permit it to recycle for the next missile launch.

Referring again to FIG. 2, after the missile 10 is fired, its optical fiber 20 must be captured by the swing arm 40 together with the previously fired optical fibers 34. If the swing arm 40 were not selectively retractable, it would be difficult to capture each additional optical fiber after its missile is launched. With the retractable swing arm illustrated in FIG. 3, a few seconds after the missile 10 has been fired, the swing arm 40 is retracted by operation of the linear motor 48, so that the previously fired optical fibers 34 are freed and relax back toward their respective launch tubes.

The rotational motor 44 is operated to rotate the swing arm support rod 38 to a position such that subsequent operation of the linear motor 48 extends the swing arm 40 to capture all of the optical fibers, including both the previously fired optical fibers 38 and the optical fiber 20 of the just launched missile 10 (the optical fiber 20 now becoming one of the previously fired optical fibers for the purposes of the analysis).

The rotational motor 44 is operated in the reverse manner to rotate the support rod 38 and the swing arm 40 to the position illustrated in FIG. 2, except that now the optical fiber of the just-launched missile is also captured and moved away from the array so that another missile can be fired from another launch tube without interference between the previously fired optical fibers and the subsequently fired missile.

Operation of the swing arm apparatus 36 in the manner described may be entirely manually controlled. Preferably, the operation is controlled by a launch control computer 49, illustrated schematically in FIG. 3. The computer 49 sequences the swing arm apparatus 36 and coordinates its operation with the firing of the missiles. Thus, the firing of the next missile will not be permitted until the swing arm has recycled.

Figure 4:
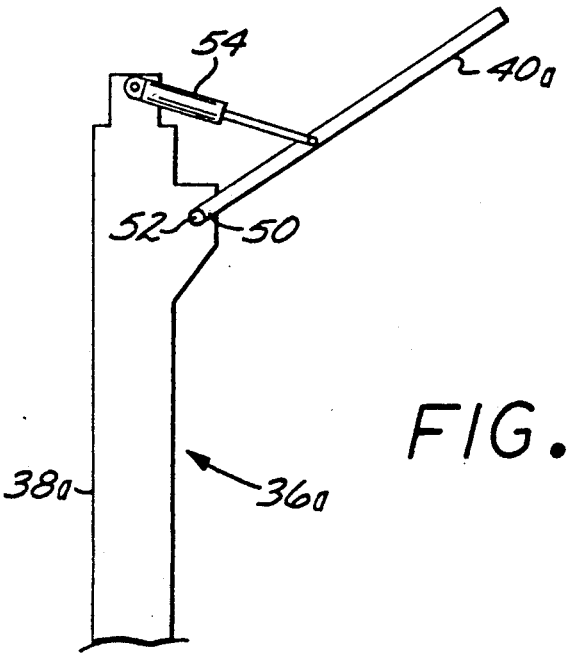
FIG. 4 is a side elevational view of another embodiment of the swing arm.

Alternative approaches to the construction of the swing arm apparatus 36 are also operable and acceptable, and one such alternative construction is shown at 36*a* in FIG. 4. When, the construction is similar to that of FIG. 3, it will not be redescribed in detail, except to not that the swing arm 40*a* is retracted by an upward pivoting motion rather than the linear retraction shown in FIG. 3. An end 50 of the swing arm 40*a* is pivotally attached to the swing arm support rod 38*a* by a pivot 52. A retractor mechanism, here illustrated as a linearly acting hydraulic cylinder 54, is attached to an intermediate location along the swing arm 40. When the swing arm apparatus 36*a* is to be operated as described above to capture the optical fiber of the just-fired missile, the hydraulic cylinder 54 is operated to cause the swing arm 40*a* to operate by pivoting upwardly. This pivoting action releases the captured previously fired optical fibers, allowing the swing arm apparatus 36*a* to be rotated in the manner previously described to capture another optical fiber.

In the launch scheme described above, the missiles are preferably launched from one side of the array first, that side being the one to which the optical fibers are gathered by the swing arm apparatus 36.

Thus, the swing arm apparatus of the invention permits the trailed optical fibers of previously fired missiles to be cleared out of the way so that there is virtually no chance of a subsquently fired missile becoming entangled in the previously fired optical fibers or damaging them with its exhaust plume. Although particular embodiments of the invention have been described in detail for purposes of illustration, various modifications may be made without departing from the spirit and scope of the invention. Accordingly, the invention is not to be limited except as by the appended claims.

What is claimed is:

1. Apparatus for launching umbilical-guided missiles, comprising:

launching means for launching umbilical-guided missiles therefrom, the launching means including means for holding and launching at least two missiles; and means for moving the umbilical of a previously launched missile away from the path of a subsequently launched missile.

2. The apparatus of claim 1, wherein the umbilical is an optical fiber.

3. The apparatus of claim 1, wherein the umbilical is a metallic wire.

4. The apparatus of claim 1, wherein the launching means includes at least two elongated launch tubes whose elongated directions are parallel to each other, each of which tubes contains a missile prior to launch.

5. The apparatus of claim 1, wherein the means for moving includes swing arm means for capturing the umbilicals of previously launched missiles and moving them to a retained position.

6. The apparatus of claim 5, wherein the swing arm means is mounted to the launching means.

7. Apparatus for launching a plurality of optical fiber-guided missiles, comprising:

a plurality of elongated launch tubes fixed together in an array, the launch tubes each being oriented to launch a missile in a common direction; and means for moving the optical fibers of previously launched missiles away from the path and exhaust plume of subsequently launched missiles.

8. The apparatus of claim 7, wherein the means for moving includes swing arm means for capturing the umbilicals of previously launched missiles and moving them to a retained position.

9. The apparatus of claim 8, wherein the swing arm means is mounted to the elongated launch tubes.

10. Apparatus for launching a plurality of optical fiber-guided missiles, comprising:

a plurality of elongated launch tubes fixed together in an array, the launch tubes each being oriented to launch a missile from a launch end of the tube in a common direction;

a swing arm assembly mounted on the array, the swing arm assembly including a swing arm extending over the launch ends of the tubes in the array; and a drive motor connected to the swing arm assembly to pivot the swing arm across the launch ends of the launch tubes.

11. The apparatus of claim 10, wherein the swing arm assembly includes extension means for extending the swing arm over the launch ends of the tubes and retracting the swing arm away from the launch ends of the tubes.

12. The apparatus of claim 11, wherein the extension means includes a linear motor and the swing arm is a telescoping rod.

13. The apparatus of claim 11, wherein the extension means includes a pivoting motor mounted on the swing arm assembly and attached to an intermediate portion of the swing arm for pivoting the swing arm out of the plane of the launch ends of the tubes.

14. Apparatus for launching a plurality of optical fiber-guided missiles, comprising:

a plurality of launch tubes disposed together in an array with a launch end of each of the launch tubes pointing in a common direction;

a plurality of guided missiles disposed within the plurality of launch tubes, one missile per launch tube;

a plurality of optical fibers, an optical fiber extending from each guided missile to its respective launch tube;

a swing arm supported on the array, the arm being operable to extend over the launch ends of the launch tubes; and a swing arm drive motor connected to the swing arm to pivot the swing arm across the launch ends of the launch tubes.

* * * * *